US006859994B2

(12) United States Patent
Oshima et al.

(10) Patent No.: US 6,859,994 B2
(45) Date of Patent: Mar. 1, 2005

(54) METHOD FOR MANUFACTURING AN INDUCTOR

(75) Inventors: Hisato Oshima, Takefuj (JP); Takeshi Shikama, Yokaichi (JP); Junichi Hamatani, Matsumoto (JP); Iwao Fukutani, Shiga-ken (JP); Kenichi Saito, Fukui-ken (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 09/950,899

(22) Filed: Sep. 10, 2001

(65) Prior Publication Data

US 2002/0067232 A1 Jun. 6, 2002

(30) Foreign Application Priority Data

Sep. 8, 2000 (JP) ..... 2000-273997

(51) Int. Cl.[7] ..... H01F 7/06

(52) U.S. Cl. ..... 29/602.1; 29/605; 29/608; 29/825; 156/169; 174/120 R; 336/84 M; 427/116

(58) Field of Search ..... 29/592.1, 602.1, 29/605–609, 618, 825, 842, 846, 857; 156/169, 173, 175, 308.2, 309.6; 336/15, 84 M; 174/120, 150 SC, 105 SC, 120 SR, 120 SC, 120 R; 427/104, 116, 117, 128, 132, 175, 375, 372.2; 528/403, 423

(56) References Cited

U.S. PATENT DOCUMENTS 4,388,371 A * 6/1983 Bolon et al. ..... 156/169
4,555,422 A * 11/1985 Nakamura et al. ..... 428/34.9
6,087,592 A * 7/2000 Nagel et al. ..... 174/120 R
6,198,373 B1 * 3/2001 Ogawa et al. ..... 336/83
6,204,744 B1 * 3/2001 Shafer et al. ..... 336/83
6,275,132 B1 * 8/2001 Shikama et al. ..... 336/83

FOREIGN PATENT DOCUMENTS

| | | |
|---|---|---|
| JP | 62-31103 | 2/1987 |
| JP | 1-199415 | 8/1989 |
| JP | 06-036937 | 2/1994 |
| JP | 7-320938 | 12/1995 |
| JP | 09-289129 | 11/1997 |
| JP | 10-210726 | 8/1998 |

* cited by examiner

*Primary Examiner*—A. Dexter Tugbang
*Assistant Examiner*—Donghai D. Nguyen
(74) *Attorney, Agent, or Firm*—Keating & Bennett, LLP

(57) ABSTRACT

A method for manufacturing an inductor is performed in such a manner that the surface of a metal wire provided with an insulating film thereon is coated with a thermal melting resin. The thickness of the thermal melting resin is, for example, approximately 1 $\mu$m. As the thermal melting resin, a thermoplastic resin or a thermosetting resin, such as a polyimide resin or an epoxy resin, containing 85 wt % of a powdered ferrite is used. This coated metal wire is densely wound to form a solenoid-type coil conductor. Next, the thermal melting resin is softened by a heat treatment at, for example, 180° C. and is then solidified by spontaneous cooling. Accordingly, the portions of the coil conductor adjacent to each other are bonded together by the thermal melting resin.

13 Claims, 4 Drawing Sheets

METHOD FOR MANUFACTURING AN INDUCTOR

BACKGROUND OF THE INVENTION

1. Field of the Invention

The present invention relates to inductors, and more particularly, relates to a high-current inductor preferably for use in eliminating noise transmitted to and generated from electronic apparatuses and other devices, and to a manufacturing method for such an inductor.

2. Description of the Related Art

Recently, in accordance with the trends towards miniaturization of circuits, higher integration thereof, and high frequency processing, high-current inductors that are compact and surface-mountable have been increasingly in demand. Conventional inductors include a wire-wound inductor having a coil conductor embedded in an encapsulating molded body. This wire-wound inductor is manufactured by densely winding a metal wire having an insulating film thereon without forming spaces between portions of the metal wire adjacent to each other to form a solenoid-type coil conductor, placing the coil conductor in a molding die, and injecting an encapsulating resin in the molding die so as to form an encapsulating molded body having the coil conductor embedded therein.

However, according to this method for manufacturing a conventional wire-wound inductor, when a thin metal wire is used for forming a solenoid-type coil conductor, it is difficult for the coil conductor to retain its shape by itself, and as a result, deformation of the coil conductor is likely to occur. Accordingly, when these coil conductors are fed in an automated manufacturing line, the coil conductors are deformed, and hence, an automated machine such as a coil inserting machine becomes unable to place the coil conductors in molding dies, which causes many problems such as automated manufacturing lines being interrupted, and other significant problems.

SUMMARY OF THE INVENTION

In order to overcome the problems described above, preferred embodiments of the present invention provide an inductor which has a greatly improved shape retaining property, is superior in mass-productivity, and is easily and effectively applied to an automated manufacturing line, and also provide a method of manufacturing such an inductor.

According to a preferred embodiment of the present invention, a method for manufacturing an inductor includes the steps of coating the surface of a metal wire having an insulating film thereon with a thermal melting resin to form a coated metal wire, winding the coated metal wire to form a solenoid-type coil conductor, performing a heat treatment on the coil conductor to soften the thermal melting resin so that portions of the coil conductor adjacent to each other are bonded together by the thermal melting resin, molding a resin containing magnetic powder into an encapsulating molded body having a predetermined shape so as to encapsulate the coil conductor, and providing external terminal electrodes on surfaces of the encapsulating molded body so as to be electrically connected with the ends of the coil conductor.

In the method described above, as the thermal melting resin, for example, a thermoplastic resin or a thermosetting resin may be used. In addition, the thermal melting resin may include magnetic powder.

According to the method described above, since the portions of the solenoid-type coil conductor adjacent to each other are bonded together by the thermal melting resin, the shape of the solenoid-type coil conductor is maintained reliably. As a result, the coil conductor is easily handled in a backend process, and interruption of a manufacturing facility caused by the deformation of the coil conductors is prevented.

According to another preferred embodiment of the present invention, an inductor includes an encapsulating molded body including a resin containing magnetic powder, a solenoid-type coil conductor encapsulated in the encapsulating molded body, external terminal electrodes which are provided on surfaces of the encapsulating molded body and which are electrically connected with the ends of the coil conductor, wherein the coil conductor is coated with a thermal melting resin and portions of the coil conductor adjacent to each other are bonded together by the thermal melting resin, and the inside and the outside of the solenoid portion of the coil conductor are filled with the resin containing the magnetic powder.

According to the unique structure of the preferred embodiment of the inductor described above, since the portions of the coil conductor adjacent to each other are bonded together by the thermal melting resin containing no magnetic powder, the magnetic resistance between the portions of the coil conductor adjacent to each other is greatly increased, and hence, a short path of the magnetic flux is prevented. As a result, most of the magnetic flux passing inside the solenoid portion of the coil conductor contributes to the inductance, and hence, DC superposition characteristics of the inductor are greatly improved.

Other features, elements, characteristics and advantages of the present invention will become more apparent from the detailed description of preferred embodiments below with reference to the attached drawings.

DETAILED DESCRIPTION OF PREFERRED EMBODIMENTS

Hereinafter, an inductor and a manufacturing method therefor according to preferred embodiments of the present invention will be described with reference to accompanying drawings.

Figure 1:
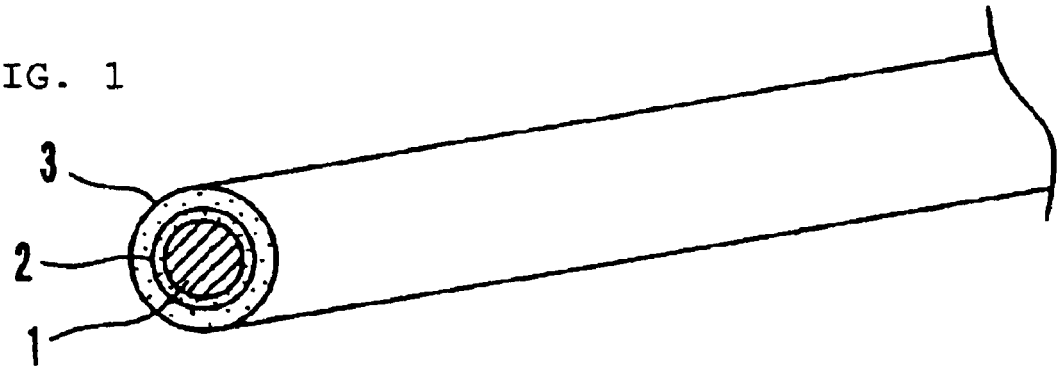
FIG. 1 is a perspective view showing a metal wire for illustrating a method for manufacturing an inductor according to a preferred embodiment of the present invention.

As shown in FIG. 1, a metal wire 1 provided with an insulating film 2 thereon is first prepared. As the metal wire 1, for example, a metal of about 200 μm in diameter including at least a material selected from the group consisting of Ag, Pd, Pt, Au, and Cu, or an alloy wire containing at least one metal mentioned above is preferably used. However, other suitable materials may also be used. As the insulating film 2, for example, a resin such as a polyester resin or a polyamide-imide resin, or other suitable material, is preferably used. A thermal melting resin 3 is coated on the surface of the insulating film 2 covering the metal wire 1. The thickness of the thermal melting resin 3 is, for example, approximately 1 μm. As the thermal melting resin 3, a thermosetting resin or a thermoplastic resin, such as an epoxy resin or a polyimide resin, containing powdered ferrite at a ratio of about 85 wt % is preferably used. Other suitable materials and compositions for the thermal melting resin 3 may also be used. Since heat is applied thereto in an injection molding step of a backend process, the thermal melting resin 3 is preferably formed of a thermosetting resin.

Figure 2:
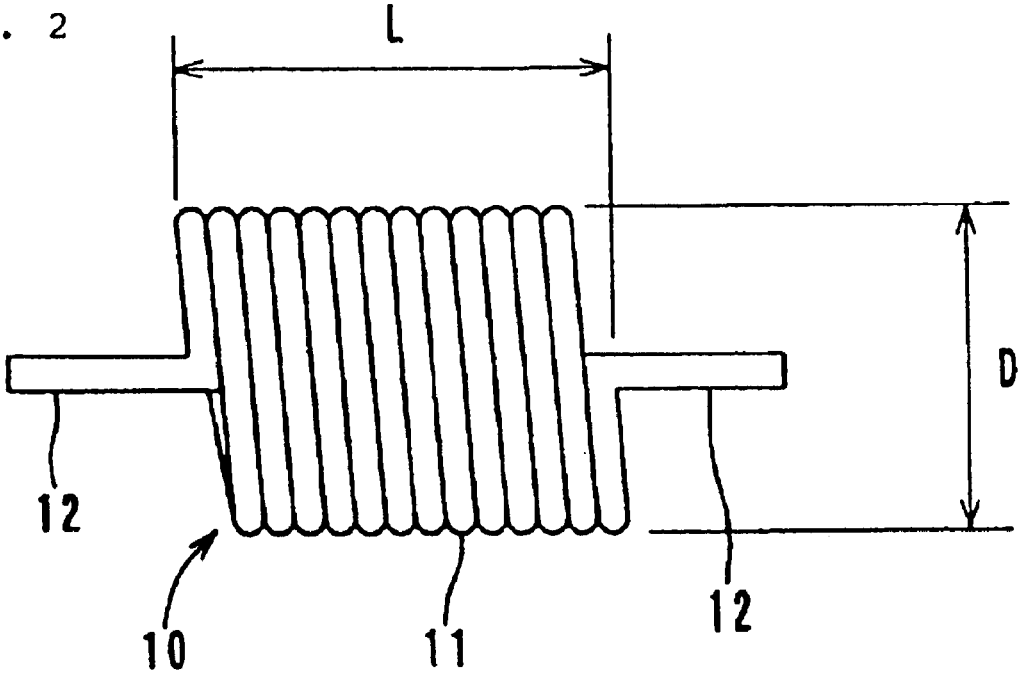
FIG. 2 is a front view showing a coil conductor for illustrating a step subsequent to that shown in FIG. 1.

Next, this insulated metal wire 1 is densely wound as shown in FIG. 2 so as to form a solenoid-type coil conductor 10. The solenoid portion 11 of the coil conductor 10 preferably has a diameter D of approximately 2.2 mm and a length L of approximately 4.6 mm. Both ends of the solenoid portion 11 are linear lead portions 12.

Figure 3:
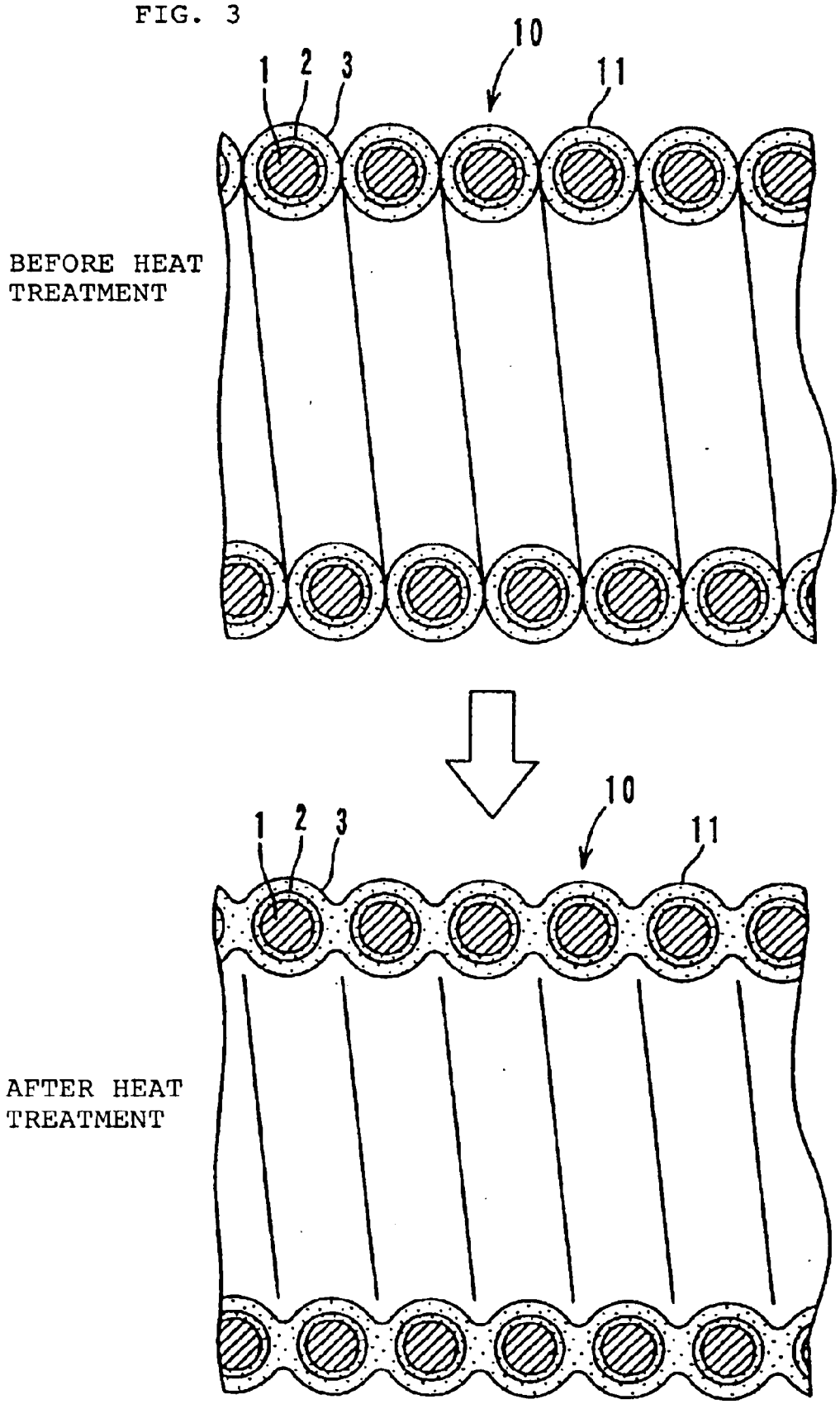
FIG. 3 is a cross-sectional view showing the coil conductor before and after a heat treatment for illustrating a step subsequent to that shown in FIG. 2.

Next, as shown in FIG. 3, the thermal melting resin 3 is softened by performing a heat treatment on the coil conductor 10 at, for example, about 180° C. and is then solidified by spontaneous cooling. As a result, the portions of the coil conductor 10 adjacent to each other are bonded together by the thermal melting resin 3.

Subsequently, the coil conductor 10 is placed in a molding die (not shown) preferably formed of polystyrene so that the coil axis is in conformity with the axis of the molding die. In this step, when an alignment hole is provided in the molding die for placing the lead portions 12 of the coil conductor 10, the coil conductor 10 can be easily placed at a predetermined position in the molding die.

Figure 4:
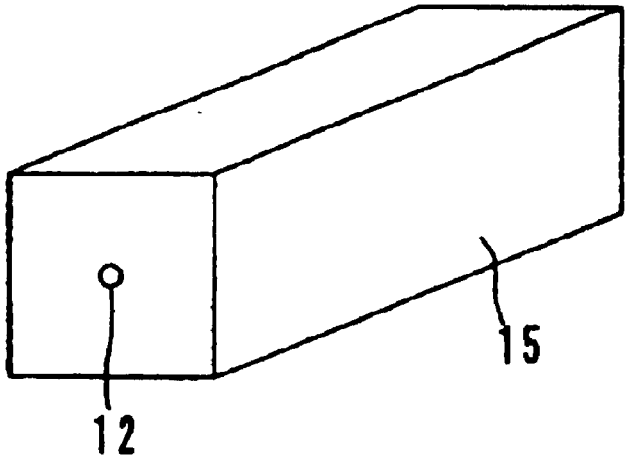
FIG. 4 is a perspective view showing an encapsulating molded body encapsulating the coil conductor for illustrating a step subsequent to that shown in FIG. 3.

In the molding die receiving the coil conductor 10 therein, a molding compound (slurry) is injected. The molding compound is preferably formed by compounding a synthetic resin, such as an epoxy resin, a polyphenylene sulfide resin, or a polyethylene terephthalate resin, as a primary component, a dispersing agent, and a powdered Ni—Cu—Zn—based ferrite. After the molding compound is solidified, the molded body is removed from the molding die, whereby a chip-type encapsulating molded body 15 having insulating properties and having a substantially rectangular parallelepiped shape as shown in FIG. 4 is obtained, and is formed of the resin containing the ferrite therein. The inside and outside of the solenoid portion 11 of the coil conductor 10 are filled with the resin containing the powdered ferrite.

Subsequently, the resin containing the powdered ferrite at both ends of the encapsulating molded body 15 is removed by using a sand blast method or other suitable method so that the end areas of the lead portions 12 of the coil conductor 10 are exposed, and in addition, the insulating film 2 and the thermal melting resin 3 covering the lead portions 12 thus exposed are also removed.

Figure 5:
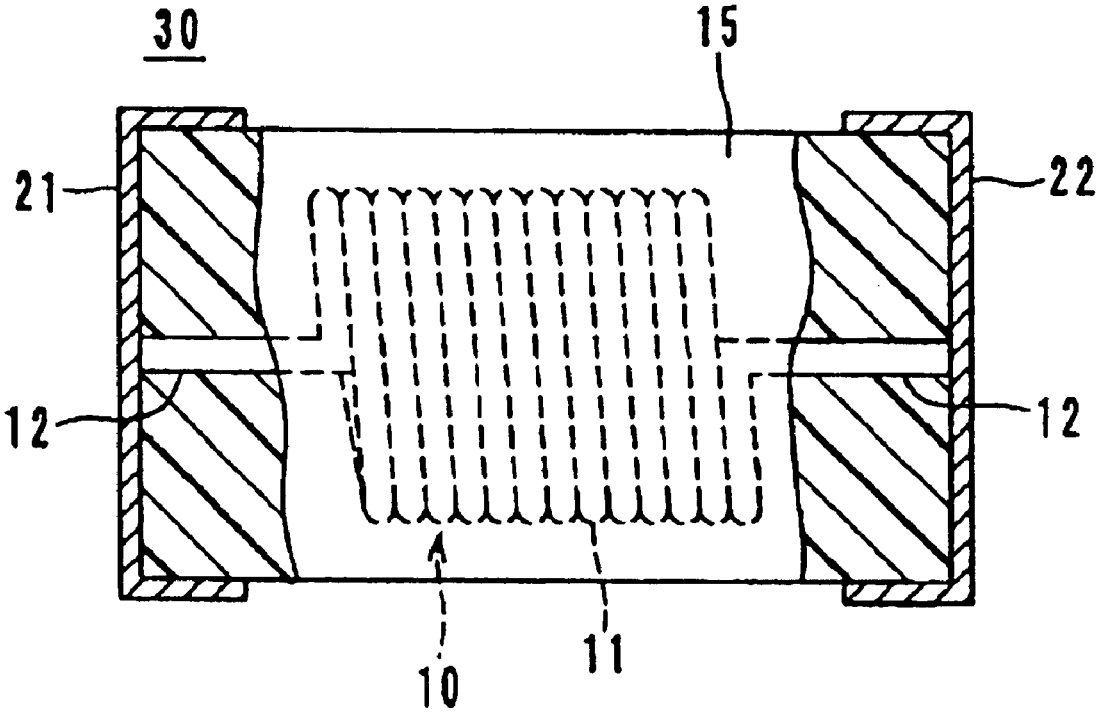
FIG. 5 is a partial view of the inductor for illustrating a step subsequent to that shown in FIG. 4.

Next, on the entire encapsulating molded body 15, an electroless plating film including Ni, Cu, or other suitable material is formed, in which the thickness thereof is preferably approximately 1 μm or less. A resist is then applied to the both ends of the encapsulating molded body 15, and an electroless plating film formed on unnecessary areas is removed by etching. The resist is then removed, and an electroplating film including Cu, Ni, Sn, Pb—Sn, Ag, Pd, or other suitable material is formed to have a thickness of approximately 15 μm to approximately 20 μm in consideration of the solderability, loss of effective area of electroplating film caused by soldering, and other factors. Consequently, as shown in FIG. 5, external terminal electrodes 21 and 22 are formed on the both ends of the encapsulating molded body 15 so as to be in electrical contact with the lead portions 12 of the coil conductors 10.

According to the manufacturing method described above, since the portions of the solenoid-type coil conductor 10 adjacent to each other are bonded together by the thermal melting resin 3, the coil conductor 10 has a greatly improved shape retaining property, and hence, the handling of the coil conductor 10 in the backend process is much easier and error-free.

In addition, examples of the coil conductors 10 according to preferred embodiments of the present invention were fed in an automated manufacturing line, and the number of interruption of the automated manufacturing line, caused by a coil inserting machine which is unable to place the coil conductor 10 in the molding die due to the deformation of the coil conductors 10, was counted. According to the results, almost no interruptions of the automated manufacturing line caused by the deformation of the coil conductors 10 were observed. In contrast, in the case of a conventional coil conductor in which the adjacent portions are not bonded together, during an 8-hour operation of the automated manufacturing line, the interruption caused by the deformation of the coil conductors occurred 5 to 100 times.

In addition, since the thermal melting resin contains a powdered ferrite, decreases in inductance and impedance do not occur. More specifically, the impedance of an obtained wire-wound inductor 30 is about 700 Ω, which is equivalent to that of a conventional inductor without using a thermal melting resin.

Figure 6:
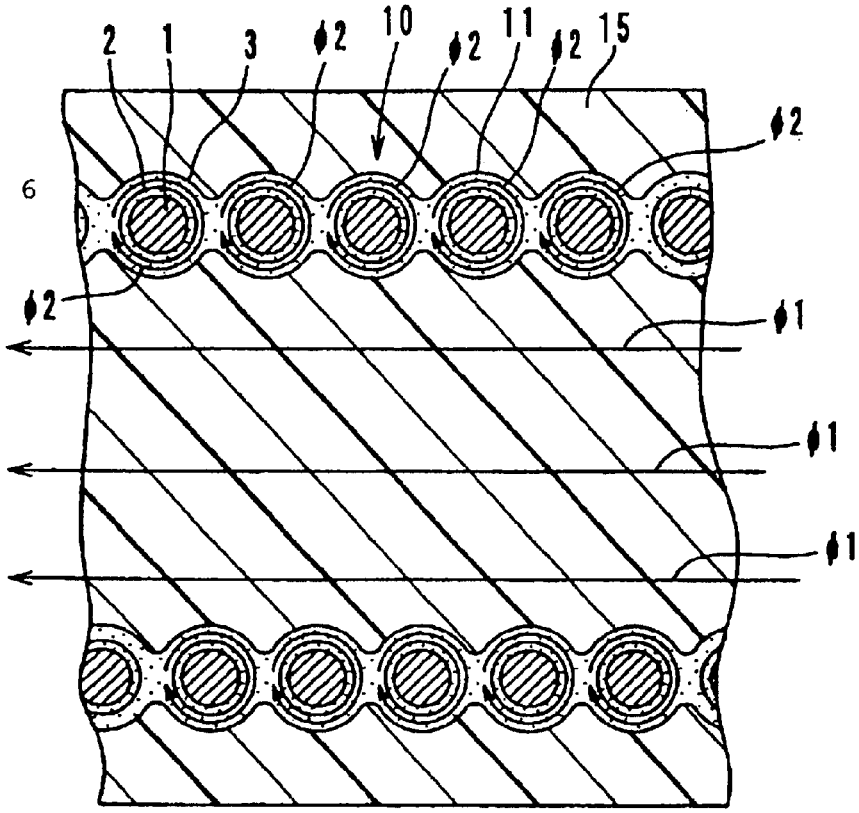
FIG. 6 is a cross-sectional view showing a state of a magnetic flux inside the inductor shown in FIG. 5.
Figure 7:
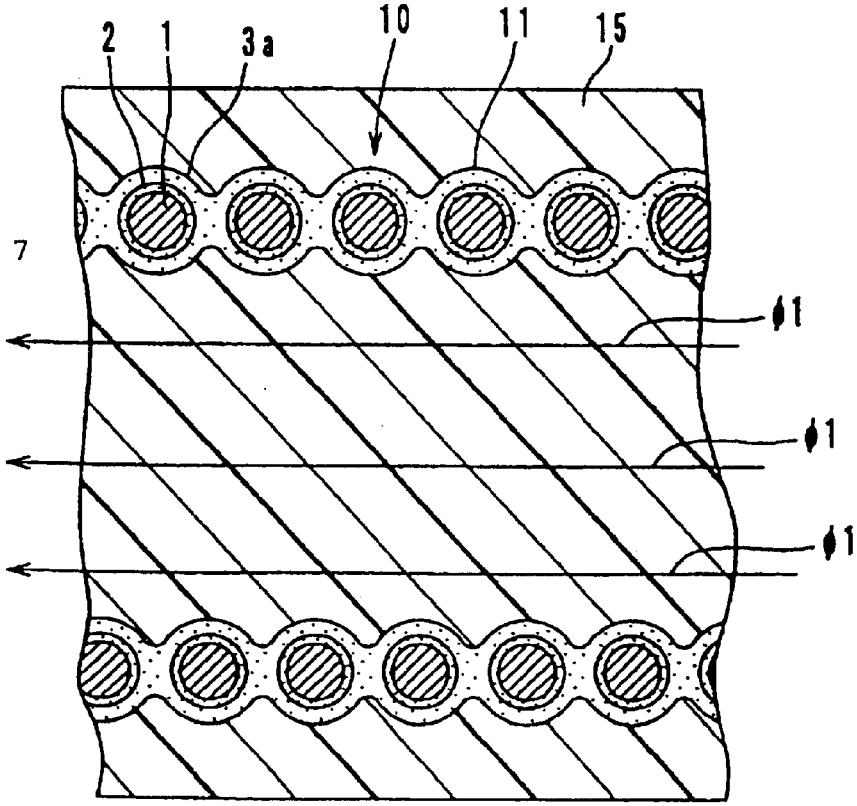
FIG. 7 is a cross-sectional view showing a modified example of the inductor shown in FIG. 5.

However, a powdered ferrite is contained in the thermal melting resin 3, a short path flux Φ2 may be generated in some cases as shown in FIG. 6. Accordingly, in order to suppress this short path flux Φ2, as shown in FIG. 7, the portions of the solenoid-type coil conductor 10 adjacent to each other may be bonded together by using a thermal melting resin 3*a* containing no powdered ferrite. As a result, since a non-magnetic resinous layers are formed between the portions of the coil conductor 10 adjacent to each other, the magnetic resistance between the portions described above is increased, and hence, the short path flux Φ2 can be suppressed. Consequently, most of the flux Φ1 passing inside the solenoid portion 11 of the coil conductor 10 contributes to the inductance, and as a result, superior DC superposition characteristics can be obtained.

The inductor and the manufacturing method therefor of the present invention are not limited to preferred embodiments described above and may be variously modified within the scope of the present invention. For example, the encapsulating molded body may have a substantially circular cross-section or other configuration in addition to a substantially rectangular cross-section, and the cross-section of the solenoid portion of the coil conductor may be substantially circular, substantially rectangular, or other suitable shape.

As has thus been described, according to the present invention, since the portions of the solenoid-type coil conductor adjacent each other are bonded together by the thermal melting resin, the shape retaining property of the coil conductor is greatly improved. As a result, the coil conductor is easily handled in the backend process, and interruption of the manufacturing facility or manufacturing processes caused by the deformation of the coil conductor is prevented.

In addition, since the portions of the coil conductor adjacent to each other are bonded together by the thermal melting resin containing no magnetic powder, the magnetic resistance between the portions of the coil conductor adjacent to each other is increased, and hence, the short path of the magnetic flux is prevented. Consequently, most of the magnetic flux passing inside the solenoid portion of the coil conductor contributes to the inductance, and as a result, superior DC superposition characteristics are achieved.

While preferred embodiments of the invention have been described above, it is to be understood that variations and modifications will be apparent to those skilled in the art without departing the scope and spirit of the invention. The scope of the invention, therefore, is to be determined solely by the following claims.

What is claimed is:

1. A method for manufacturing an inductor, comprising the steps of:

coating a surface of a metal wire having an insulating film thereon with a thermoplastic resin containing magnetic powder to form a coated metal wire;

winding the coated metal wire in a single layer to form a solenoid-type coil conductor which is hollow in the inside of the solenoid-type coil conductor;

performing a heat treatment on the coil conductor to soften the thermoplastic resin so that portions of the coil conductor that are adjacent to each other are bonded together by the thermoplastic resin;

filling a resin containing magnetic powder by injection-molding inside and outside the solenoid-type coil conductor which is placed within a molding die to from an encapsulating molded body having a predetermined shape so as to encapsulate the coil conductor;

removing the encapsulating molded body from the molding die; and providing external terminal electrodes on surfaces of the removed encapsulating molded body so as to be electrically connected with the ends of the coil conductor; wherein the steps of winding the coated metal wire, performing heat treatment and filling a resin are performed in this order.

2. A method for manufacturing an inductor according to claim 1, wherein the metal wire has a diameter of about 200 $\mu$m.

3. A method for manufacturing an inductor according to claim 1, wherein the metal wire includes a material selected from the group consisting of Ag, Pd, Pt, Au, and Cu.

4. A method for manufacturing an inductor according to claim 1, wherein the insulating film is made of one of a polyester resin and a polyamide-imide resin.

5. A method for manufacturing an inductor according to claim 1, wherein the thickness of the thermoplastic resin is approximately 1 $\mu$m.

6. A method for manufacturing an inductor according to claim 1, wherein the resin includes one of an epoxy resin and a polyimide resin, containing powdered ferrite at a ratio of about 85 wt %.

7. A method for manufacturing an inductor according to claim 1, wherein the step of performing the heat treatment includes softening the thermoplastic resin by heating the coil conductor at a temperature of about 180° C.

8. A method for manufacturing an inductor according to claim 7, further comprising the step of solidifying the thermoplastic resin via cooling the thermoplastic resin after the heat treatment.

9. A method for manufacturing an inductor according to claim 1, wherein the step of filling includes using a molding compound that is formed by compounding one of a synthetic resin and a polyethylene terephthalate resin as a primary component, a dispersing agent, and a powdered Ni—Cu—Zn—based ferrite.

10. A method for manufacturing an inductor according to claim 1, further comprising the step of removing the resin containing the powdered ferrite at both ends of the encapsulating molded body before the step of providing the external terminal electrodes.

11. A method for manufacturing an inductor according to claim 1, wherein the step of providing the external terminal electrodes includes forming an electroless plating film on ends of the encapsulating molded body, forming a resist on both ends of the encapsulating molded body, removing unnecessary portions of the electroless plating film, and removing the resist.

12. A method for manufacturing an inductor according to claim 1, wherein the step of winding the coated metal wire includes the step of densely winding the coated metal wire such that adjacent portions of the thermoplastic resin are in contact with one another.

13. A method for manufacturing an inductor according to claim 1, wherein the step of winding the coated metal wire includes the step of winding the metal wire such that no portion of the metal wire overlaps another portion of the metal wire in a radial direction thereof.

* * * * *